US006427617B1

(12) United States Patent
Breivik et al.

(10) Patent No.: US 6,427,617 B1
(45) Date of Patent: Aug. 6, 2002

(54) FLOATING LOADING HOSE

(75) Inventors: Kåre Breivik, Tau; Harald Kleppestø, Bryne; Erik Hilden Tor, Stavanger, all of (NO)

(73) Assignee: Navion AS, Stavanger (NO)

( * ) Notice: Subject to any disclaimer, the term of this patent is extended or adjusted under 35 U.S.C. 154(b) by 0 days.

(21) Appl. No.: 09/600,974

(22) PCT Filed: Jan. 29, 1999

(86) PCT No.: PCT/NO99/00025

§ 371 (c)(1),
(2), (4) Date: Jul. 25, 2000

(87) PCT Pub. No.: WO99/38761

PCT Pub. Date: Aug. 5, 1999

(30) Foreign Application Priority Data

Jan. 30, 1998 (NO) ..... 19980431

(51) Int. Cl.[7] ..... B63B 21/00
(52) U.S. Cl. ..... 114/230.1; 141/279
(58) Field of Search ..... 441/3, 4, 5; 114/230.1, 114/230.2; 141/232, 279

(56) References Cited

U.S. PATENT DOCUMENTS 3,700,014 A * 10/1972 Scales ..... 141/279
3,766,938 A * 10/1973 Stracke et al. ..... 141/279
3,833,032 A 9/1974 Hnot ..... 141/232
4,231,398 A * 11/1980 Gibbons ..... 114/230.1
5,836,361 A * 11/1998 Koncsek ..... 141/279

FOREIGN PATENT DOCUMENTS

| | | |
|---|---|---|
| DE | 28 17 728 | 10/1979 |
| EP | 0 396 391 | 11/1990 |
| WO | 98/32651 | 7/1998 |

* cited by examiner

*Primary Examiner*—S. Joseph Morano
*Assistant Examiner*—Lars A. Olson
(74) *Attorney, Agent, or Firm*—Foley & Lardner

(57) ABSTRACT

Device for storage or mooring of a loading hose (1), preferably for unloading of petroleum fluids from a vessel (100) at sea, with a floating loading hose (1) with the first end (1*a*) connected to an after manifold (6) of the vessel (100), with the second, free end (1*b*) of the loading hose (1) arranged to be caught and connected preferably to a midship manifold (7) of an other vessel (200). (a) A swivel (8) arranged for permanent pivotable connection between the first end (1*a*) of the loading hose (1) and the after manifold (6). (b) Hoisting appliances (9) with movable catch hooks (14) adapted to the loading hose (1) and arranged with mutual separation along the hull's side (102) forward from the after manifold (6) and arranged for complete or partial elevation of the loading hose (1) from the natural floating position.

8 Claims, 5 Drawing Sheets

FLOATING LOADING HOSE

Figure 1A:
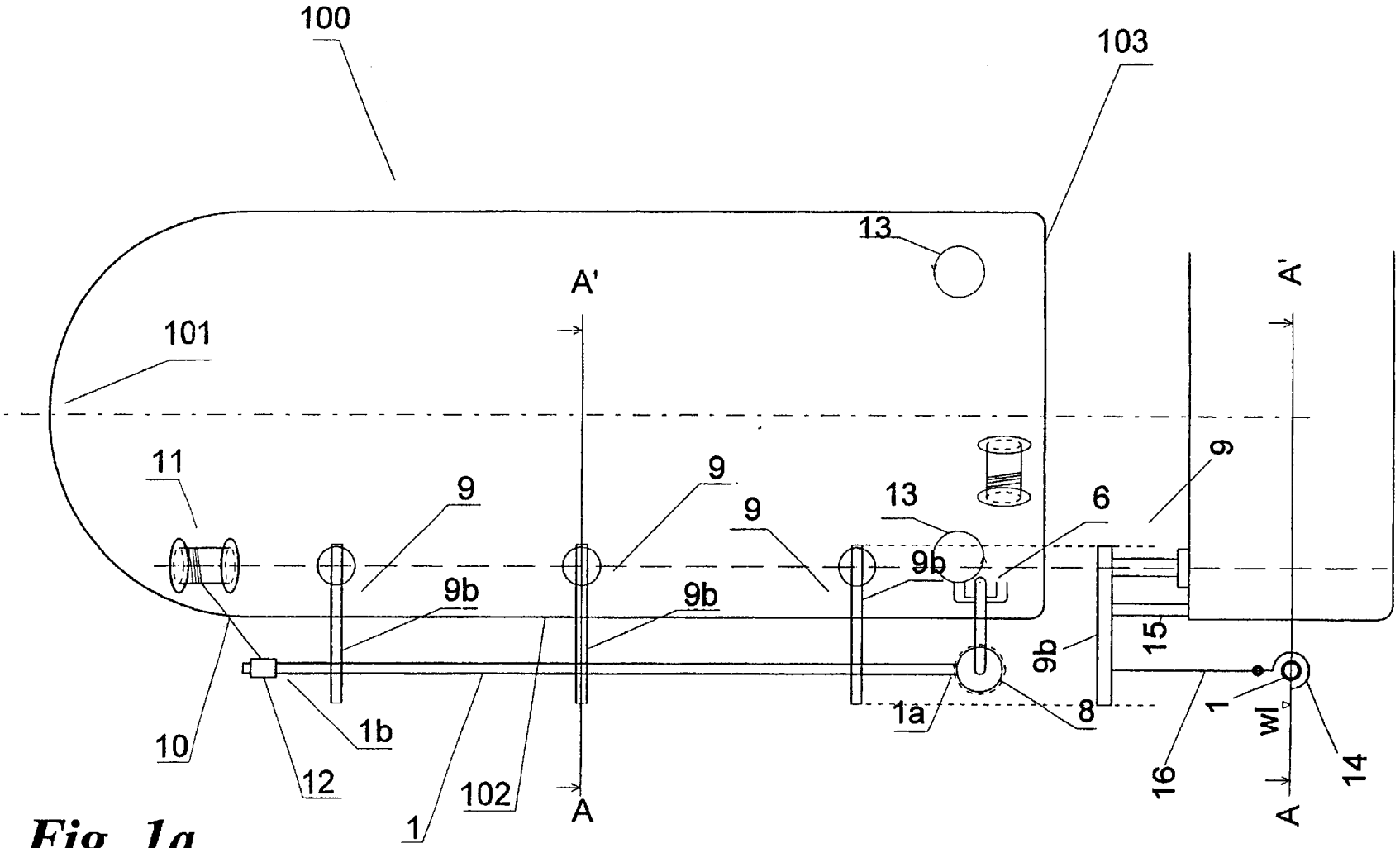

This invention relates to a device for load transfer, particularly transfer of petroleum fluids, between two vessels at sea, comprising at least a loading hose arranged to be drawn between an after manifold at the stern of a first vessel and a midship manifold at a second vessel.

This invention particularly relates to a device for mooring and storage of a normally floating loading hose when the loading hose is not used for transfer of petroleum fluids from a vessel at sea, preferably a floating (production,) storage and off-loading vessel FSO/FPSO.

Load transfer between to vessel units at sea is an especially demanding task, particularly due to persisting relative movement between the vessels. A known method to perform this kind of operation is to arrange the vessels in a tandem, that is, the second vessel moored from the bow party to the stern of the first vessel. Typically this may be a so-called FPSO (Floating Production, Storage and Off-loading), while the other may be a tank vessel, particularly known as a shuttle tanker. A floating loading hose may be used for the transfer, i.e. the discharging or unloading from the FPSO and the loading of the shuttle tanker, whereas such a loading hose is constructed or arranged to float at the sea surface and to be towed on board to the shuttle tanker before load transfer. Modern shuttle tankers may have a bow manifold for charging, but a major proportion of the conventional shuttle tankers usually have a charging device consisting of a midship manifold for intake of the oil load. For this reason a relatively long loading hose is needed, from the stern on the FSO/FPSO-vessel to the midship manifold on the shuttle tanker. The separation between the vessels, i.e. between the stern of the FPSO-vessel and the bow of the shuttle tanker may be about 50 to 90 meters, and the extension of the loading hose is normally between 150 and 300 meters. The internal diameter of the loading hose will normally be between 10 and 20 inches, i.e. between 25 and 50 cm, adapted to the actual pumping rate for the oil charge. Conventionally the bullnose end of the loading hose is brought to the shuttle tanker by means of a dedicated auxiliary craft, e.g. a tender.

Obviously such loading hoses floating freely in the sea in the periods between load transfer operations, may be subject to wear and by that risk damage, both to the loading hose and its connection with the vessel, whether the weather conditions are difficult or not, but particularly due to wave action. Under the present conventional storage method where the loading hose is drifting with the weather, hanging astern from the FPSO-vessel (which also may be lying on the weather, preferably single point moored, freely rotatable on a turret) the experience has shown that the loading hose is worn due to wave action, gradually leading to loss of the buoyancy and beginning to sink, or that it is torn off and lost. This of course implies a considerable expense and a time loss, leading to delays and extra work being disproportionally expensive because of extraordinary operation out of the schedule, remotely at sea and often under heavy weather, with the problems imposed by such a replacement both with respect to logistics and with respect to working conditions, both of which relates to safety. Keeping a shuttle tanker lying waiting also leads to loss of money.

By a conventional method according to the above, where a mostly conventional tank vessel shall receive a fluid load from an FPSO, a loading hose is laid out astern from the FPSO-vessel and along the hull's side of the tanker vessel for coupling to a midship manifold or the like, which is normally situated about midship of the tanker vessel. When the shuttle tanker leaves the FPSO-vessel after the end of loading, the bullhead of the loading hose is dropped to the sea.

On the background of the above mentioned known art the invention comprises a device for arrangement of the loading hose during the times between the load transfer operations. The new and characteristic traits are primarily comprised of a hose swivel arranged for permanent swivelled connection between one of the ends of the loading hose and an after manifold, and also mutually separated hoisting appliances with movable catch hooks adapted for the loading hose, and arranged from the after manifold forward along the hull's side, adapted to complete or partial hoisting of the loading hose from the natural floating position.

Thus one achieves a device that gives a safe mooring possibility with the loading hose pivoted in a forward direction about a hose swivel on the after manifold and laid towards the hull's side of the FPSO-vessel or the FSO-vessel. When the loading hose is laid parallel with the hull's side, it may be engaged by the catch hooks of the hoisting appliances along the hull's side. The loading hose may then be hoisted completely or partially from the sea and thus become less exposed to waves and current with the inherent wear and damage of which the loading hose otherwise would have been subject to if it were freely floating in the sea.

Among the achieved advantages by such a solution we here mention a substantially prolonged lifetime for the loading hose, less maintenance work, improved reliability for commencing the load transfer on schedule, reduced delay for shuttle tankers due to a defect loading hose, improved safety for vessels operating astern of the FPSO-vessel because no loading hose is drifting in the sea during intervals between load transfer operation times. If improved reliability for load transfer from the FPSO-vessel to the shuttle tankers is achieved, one may be able to keep a more even and higher production of oil from the reservoir.

The favourable mooring conditions achieved for the loading hose obviously depend on the number of hoisting appliances, their location on the deck and their mutual separation, the design of the catch hook devices and how high out of the sea one may, or wish, to hoist the loading hose. Clearly, under fair weather conditions it may suffice only to engage the catching devices to the loading hose, and hoisting it only partially up from the sea. On the contrary, it may, during heavy weather or -wave conditions, be necessary to hoist the loading hose completely up and above the sea in order to avoid damage on, or loss of, the loading hose.

As will emerge from the following, it may for certain conditions and operations, be safeguarded considerable additional advantages by using a winch or hoisting crane arranged leading in the direction of the bow with respect to the leading crane, and arranged to winch and tighten up the loading hose by means of a hauling line attached near the free (bullnose) end of the loading hose.

The solutions comprised by the invention may be adapted for several modes of operation, such as:

An essentially stationary vessel of the FSO or FPSO type in harsh weather areas, possibly also in less demanding weather areas.

The load to be transferred is oil.

Transfer of the oil and return of gas (VOC—Volatile Organic Compounds).

As for this, it must be mentioned that particularly during the waiting interval between the previously described known tandem operations of load transfer between two vessels under weather conditions or situations as mentioned in the previous chapter, the known holding position and imperfect mooring methods often implies considerable risks as for wear, sinking and average of the loading hose.

Such unwanted incidences will, by means of the device according to the invention, be substantially eliminated by ensuring that the loading hose is hoisted or lifted mostly out of the sea during periods when it is not used for load transfer. The pivoting turning to the forward pointing direction can be performed by means of lines or wires drawn between the FPSO-vessel and the loading hose, but in a preferred embodiment of the invention be performed by means of an auxiliary craft or tender. It is also possible to bring the loading hose towards the FPSO hull's side by rotating it by means of the FPSO-vessel's own engine force.

Figure 1B:
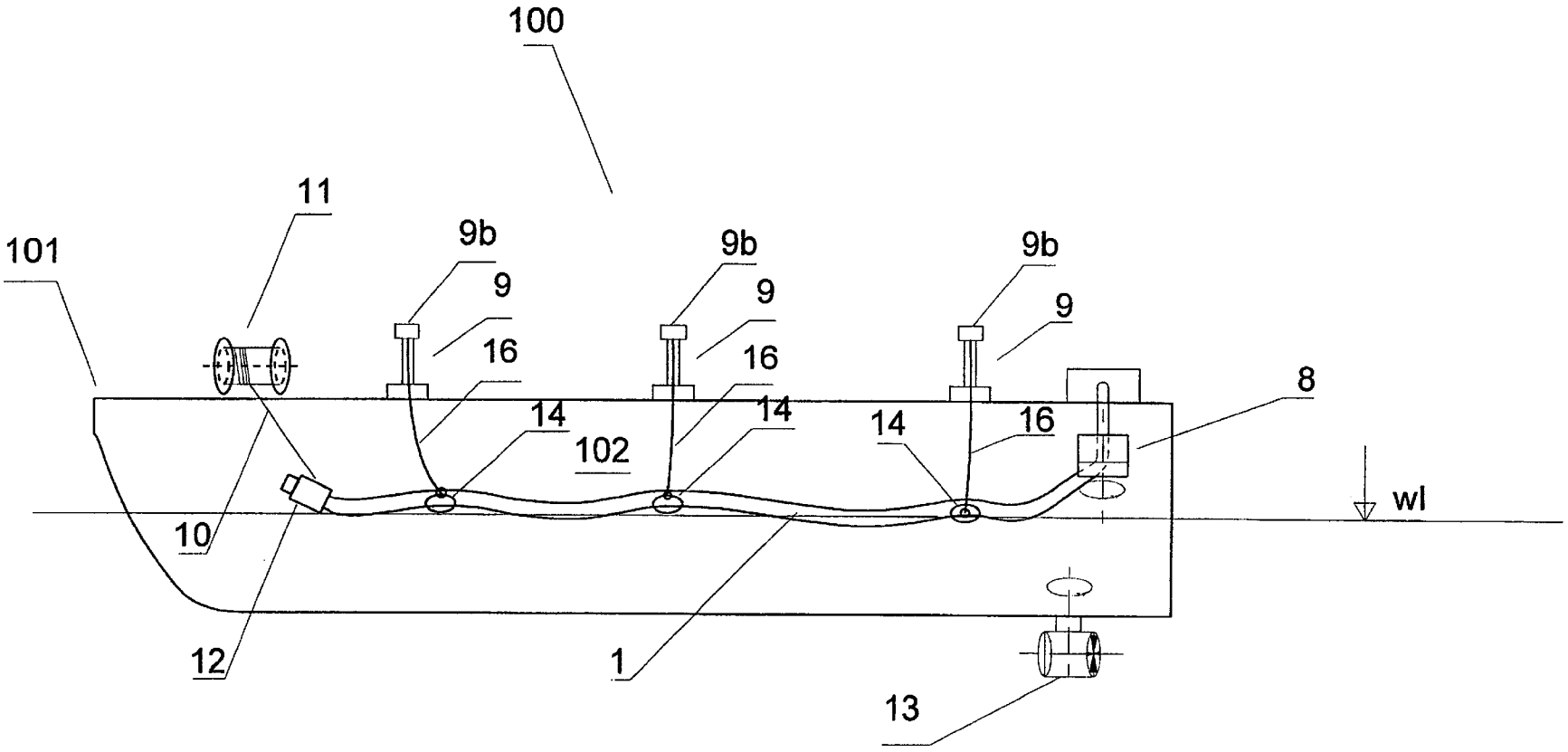

The invention will be explained in more detail in the following chapters. The invention will be explained with reference to embodiments that are illustrated in the following figures:

FIG. 1*a* shows a plane view of the FPSO-vessel with a device according to the invention in a moored position in the period between load transfer operations, and FIG. 1*b* shows, in an elevation view from the port side, the FPSO-vessel with the loading hose lying in a partially hoisted position from the sea, along the hull.

Figure 2A:
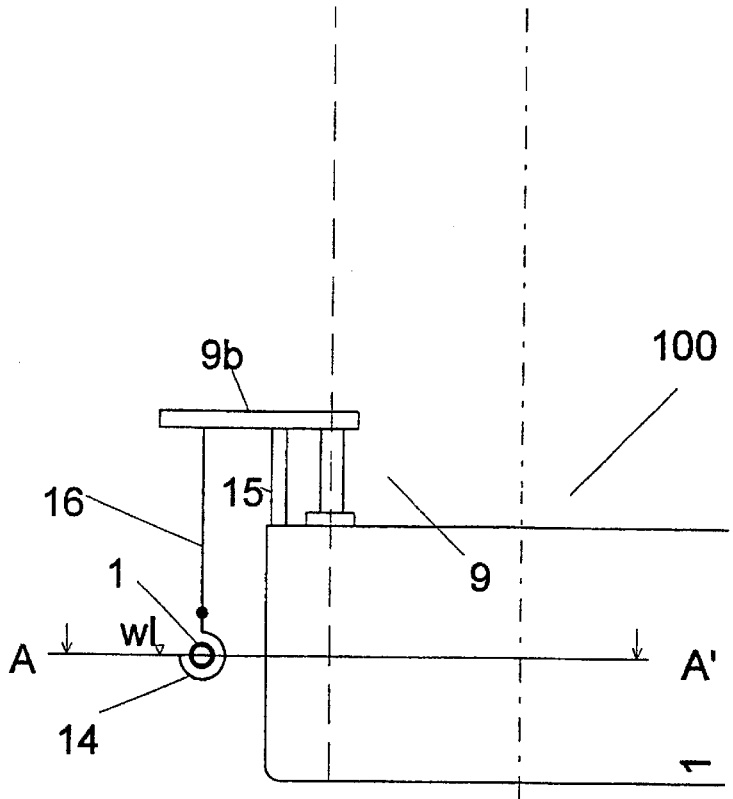

FIG. 2*a* shows, a vertical section along A–A' from FIG. 1*a,* a hoisting device placed in an engagement position on the loading hose.

Figure 2B:
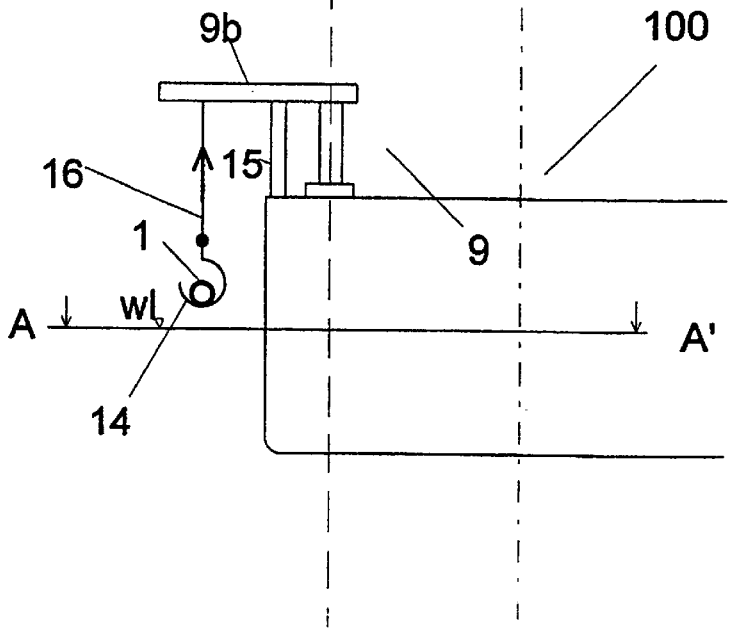

FIG. 2*b* shows a vertical section along A–A' from FIG. 1*a*, a hoisting appliance with the loading hose in a hoisted position from the sea.

Figure 2C:
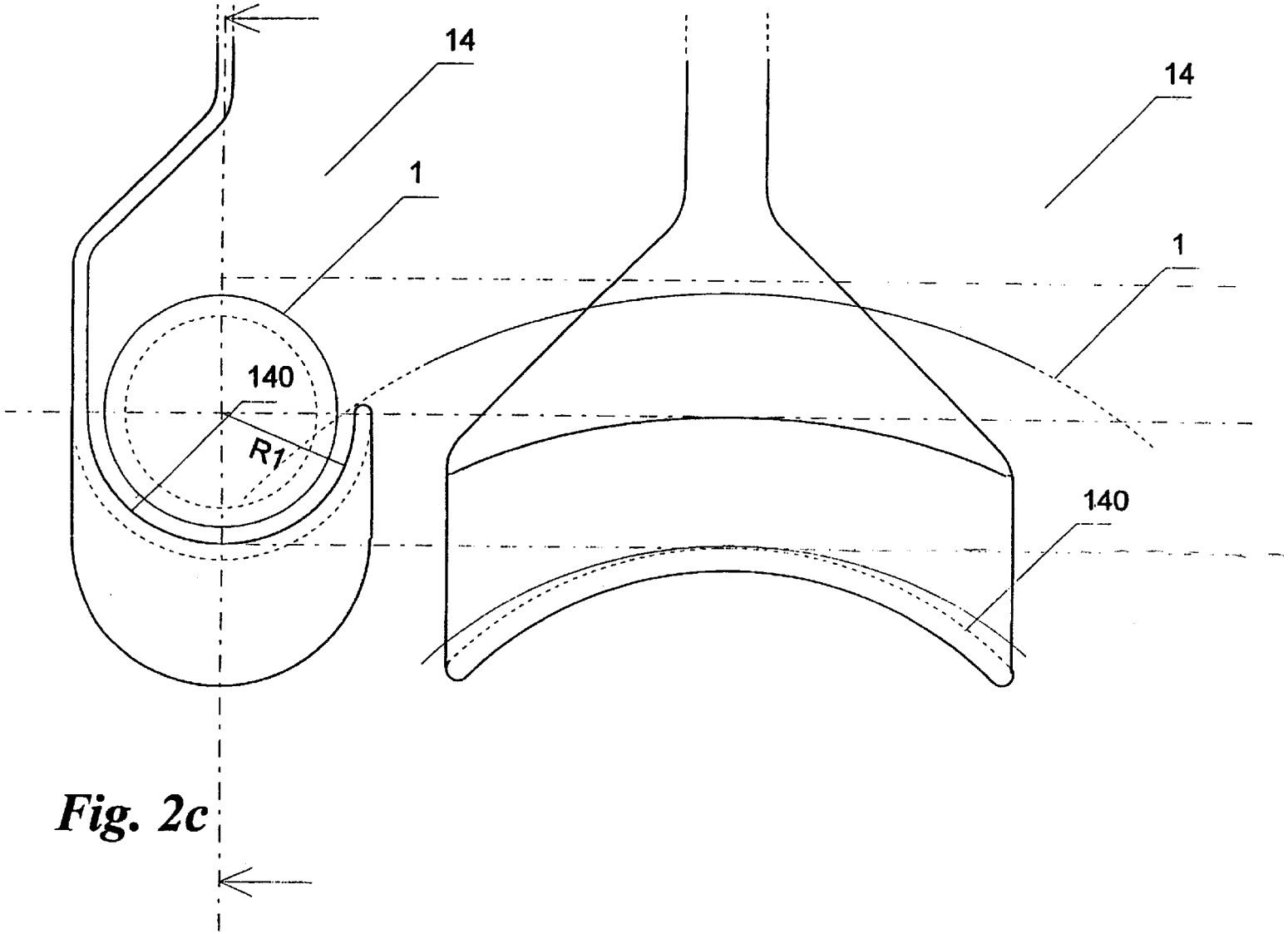

FIG. 2*c* illustrates two mutually orthogonal elevational section views of the catch hook for the loading hose.

Figure 3:
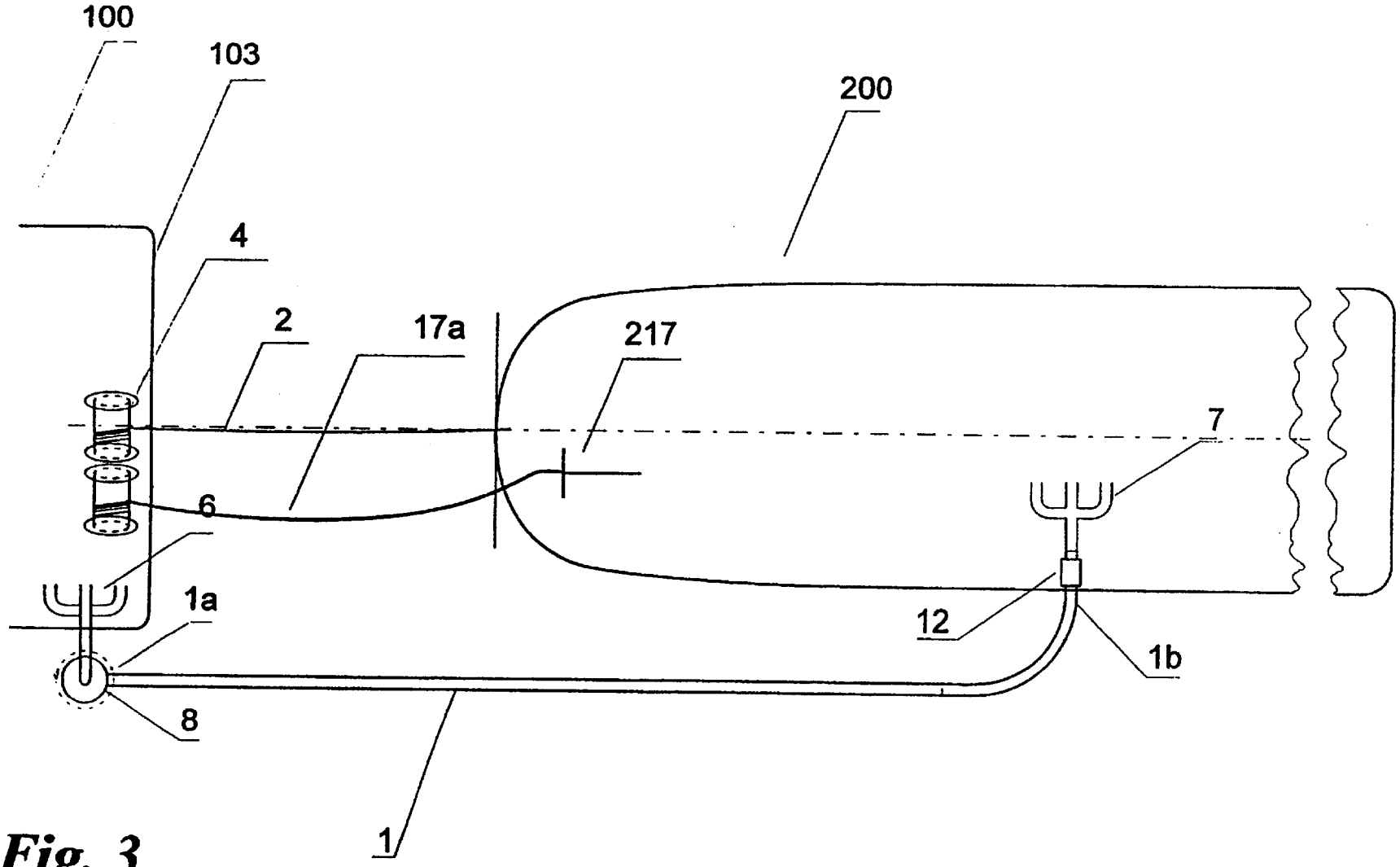

FIG. 3 shows the vessels in tandem for load transfer.

Referring to the drawings, FIG. 1*a* shows a first vessel 100 (typically an FSO or an FPSO) with a loading hose 1 in the storage or mooring position along the hull's side 102. Along the hull's side 102 hoisting appliances 9 are arranged, with even separation, forward from the after manifold 6. The loading hose is in the one end 1*a* connected to the after manifold 6 via an interconnected hose swivel 8. The opposite free end 1*b* of the loading hose 1 has a bullnose 12 arranged for load transfer connection to preferably a midship manifold 7 on an other vessel 200 (not shown) e.g. a shuttle tanker. The free end 1*b* has in a preferred embodiment a hauling line 10 on a winch or crane 11 being arranged closer to the bow 101 than the leading hoisting appliance 9. The hauling line 10 is arranged to tighten up the loading hose by means of the winch or crane 11 when the loading hose is hoisted by means of the hoisting appliances 9, or put in the moored position along the hull's side 102. In this way the free end 1*b* and the bullhead 12 is secured from swinging freely to be damaged toward the hull's side 102, and that the loading hose 1 is tightened up lengthwise so that the loading hose's freedom to swing sideward is reduced. This facilitates simpler access to maintain the bullnose 12. This also gives the arrangement of the loading hose 1 stored along the hull's side 102 of the vessel 100 the possibility to connect the free end 1*b* (the "bullnose") of the loading hose 1 to the to the tube system of the FPSO/FSO-vessel 100 and gives the possibility to empty the loading hose 1 for oil by pumping in e.g. water from the other end 1*a* of the loading hose 1. Environmentally this gives another advantage by eliminating pollution by oil release when a loading hose goes average. The hoisting appliance 9 comprises in a preferred embodiment each their boom 9*b* being adjustable in their horizontal extent from the hull's side 102, with wires 16 arranged to keep the catch device or catch hook 14 in an adjustable vertical elevation hanging from the end of the boom 9*b*, as shown in the FIGS. 2*a* and 2*b*.

FIG. 2*a* shows in a section A–A' in FIG. 1 how the loading hose 1 can be situated when arranged in the sea along the hull's side 102 by the FPSO-vessel. The catch hooks 14 are here arranged engaging the loading hose 1. The horizontal movement of the catch hooks 14 toward the loading hose 1 may be effected by horizontal adjustment of the booms 9*b* on the hoisting appliances 9, or effected by sideward directed force of the propulsive power of the FPSO-vessel 100, either by means of thrusters 13 or by means of the main propeller and the rudder. The loading hose may also be handled into an engagement position toward the catch hooks 14 by means of a tender (not shown).

FIG. 1*b* displays how the vessel 100 in a preferred embodiment of the invention has at least two, preferably three or more hoisting appliances 9 arranged mainly near the vessel's 100 after 103, midship, and near the bow 101. Depending on the bending capability and tensile strength of the loading hose 1, more than three hoisting appliances 9 may be arranged along the hull's side 102. In a preferred embodiment each catch hook's 14 arc of contact 140 is arranged as a doubly curved saddle giving an arc of contact arranged to give an even bearing load force on the lower side of the stored loading hose. It must be emphasized that the catch organs or catch hooks 14 has a shape being rounded and adapted to the hose, preferably with a doubly curved (saddle) shape, arranged to engage and hold the loading hose in a doubly curved concave-convex arc of contact track which along an axis of the loading hose has a bending radius somewhat 1*a* rger than the loading hose, and which about an athwart axis has a bending radius 1*a* rger than the minimum allowed bending radius of the loading hose, such that the loading hose is held stably sideward and not bent past its allowed bending radius. Such sparing catch hooks 14 adapted for flexible hoses ar described in the known art, and are illustrated in FIG. 2*c*.

FIG. 3 shows vessels 100 and 200 in tandem under transfer of oil via the loading hose 1. The shuttle tanker's bow 201 is moored to the after 103 of the FPSO-vessel by means of a bow hawser 2. In a preferred embodiment of the invention VOC-gas may be returned from the vessel 200 to the main vessel 100. This return goes from a bow manifold 217 via a return hose 17*a*. The return hose 17*a* may be stored on a drum 17 when not used in a loading operation. The loading hose 1 is taken on board by the side of the hull 202 and connected via the bullnose 12 to a midship manifold 7 of the shuttle tanker 200. The shuttle tanker may be assisted by an auxiliary vessel (not shown) to keep a correct position with respect to the FPSO-vessel 100.

The embodiment of the swivel 8, as such, is a task for the skilled person when regarding the known art.

What is claimed is:

1. A system for storing a loading hose for transfer of petroleum fluids from a leading vessel at sea, in which said loading hose is intended to be transferred from an inactive position where said loading hose is stored above sea level to an active position, substantially floating on the sea level, for transfer of said petroleum fluids, said loading hose having a first end connected to an after manifold located on said leading vessel and a free end arranged to be connected to a midship manifold of a trailing vessel, the system comprising:

said loading hose, when in said inactive position having said free end pointing forwardly in a longitudinal direction of said leading vessel, while pointing aft when in said active position, connected to said trailing vessel;

said loading hose in said inactive position are arranged for being stored along a side of the hull of said leading vessel, suspended from a plurality of hoisting appliances arranged along said side of said hull;

a hose-swivel arranged for permanent rotatable connection between said first end of said loading hose and said after manifold, enabling said loading hose to be swung from said inactive position to said active position or vice versa; and said plurality of hoisting appliances having movable catching hooks adapted to receive said loading hose, said hoisting appliances being generally equally spaced along a side of said hull of said leading vessel extending forward from said manifold, and being adapted for complete or partial hoisting of said loading hose from a natural floating position.

2. The system of claim 1, wherein each hoisting appliance comprises a boom adjustable in the horizontal direction from said side of the hull; and a wire arranged to hold said catching hook, said wire hanging from an outer end of said boom and configured to be adjustable to raise and lower said hook.

3. The system according to claim 1, further comprising a winch positioned closer to the bow of said leading vessel than each of said hoisting appliances, and arranged to haul in a hauling line attached said free end of said loading hose.

4. The system according to claim 1, wherein the system includes hoisting appliances positioned adjacent to the stem, bow and midship of said leading vessel.

5. The system according to claim 1, wherein each of said hooks comprise a contact surface for receiving said loading hose and wherein said contact surface has a doubly curved saddle for providing an even bearing load force on a lower side of said loading hose.

6. A method for storing a floating hose for transfer of petroleum fluids from a leading vessel at sea to a trailing vessel, in which said loading hose is intended to be transferred from an inactive position where the loading hose is stored above the sea level to an active position, substantially floating on the sea level, for transfer of said petroleum fluids, the loading hose having a first end connected to an after manifold located on said leading vessel and a free end arranged to be connected to a midship manifold of a trailing vessel, the system comprising alongside a leading vessel at sea comprising the steps of:

providing said loading hose floating on the sea surface and having its first end connected with an after manifold on said leading vessel, said loading hose having a free end configured for connection to a midship manifold of another, trailing vessel;

pivoting said loading hose about its said first end from a rearwardly directed position forward to a mooring position along a side of the hull of said leading vessel;

providing hoisting appliances having movable catching hooks, said appliances being arranged with mutual separation along said side of the hull of said leading vessel;

engaging said loading hose with said catching hooks;

elevating said loading hose above a natural floating position for storage along said side of the hull.

7. The method of claim 6, further comprising the steps of:

attaching a hauling line to said loading hose's said free end using a winch arranged at the opposite end of said leading vessel with respect to said after manifold; and hauling in said free end of said loading hose; and securing said free end to said leading vessel.

8. The method of claim 6, wherein each of said hoisting appliance includes a boom, and said catching hook hangs from a wire positioned at an outer end of said boom, wherein said step of said loading hose with said catching hooks comprises the steps of:

lowering said catching hooks down to the elevation of said hose; and adjusting the position of said outer end of said boom re 1*a* to said leading vessel.

* * * * *